US008403252B2

(12) United States Patent
Muir

(10) Patent No.: US 8,403,252 B2
(45) Date of Patent: Mar. 26, 2013

(54) PRINT MEDIA TENSIONING APPARATUS INCLUDING GIMBALED ROLLER

(75) Inventor: Christopher M. Muir, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 388 days.

(21) Appl. No.: 12/712,271

(22) Filed: Feb. 25, 2010

(65) Prior Publication Data

US 2011/0206440 A1 Aug. 25, 2011

(51) Int. Cl.
*B65H 23/00* (2006.01)
*B65H 77/00* (2006.01)

(52) U.S. Cl. ..... 242/615.1; 226/1; 226/21; 226/180; 226/190; 242/615.2

(58) Field of Classification Search ..... 226/1, 3, 226/21, 22, 23, 180, 190; 242/548, 566, 242/615.1, 615.2; 198/806–808
See application file for complete search history.

(56) References Cited

U.S. PATENT DOCUMENTS 2,454,863 A 11/1948 Crocker
2,797,091 A * 6/1957 Fife ..... 226/22
3,054,547 A * 9/1962 Alexeff et al. ..... 242/615.1
3,069,056 A * 12/1962 Richards et al. ..... 226/22
3,300,114 A 1/1967 Jacobsen
3,373,288 A * 3/1968 Otepka et al. ..... 250/548
3,436,002 A 4/1969 Racine
3,452,908 A * 7/1969 Hindle et al. ..... 226/21
3,595,459 A * 7/1971 Colombo ..... 242/615.1
4,243,167 A * 1/1981 Sander ..... 226/21
5,906,305 A * 5/1999 Knorr ..... 226/21

FOREIGN PATENT DOCUMENTS

EP 0 803 458 A2 10/1997
GB 808 686 A 2/1959

* cited by examiner

*Primary Examiner* — Michael Mansen
*Assistant Examiner* — Scott Haugland
(74) *Attorney, Agent, or Firm* — William R. Zimmerli

(57) ABSTRACT

An apparatus for maintaining uniform tension across a width of a web including a frame, a roller, a shaft about which the roller rotates, a first arm rigidly connected to a first end of the shaft, a second arm pivotally connected to a second end of the shaft, and a third arm rigidly connected to the second end of the shaft. The first arm is pivotally connected to the frame by a first joint. The second arm is pivotally connected to the shaft by a second joint and to the frame by a third joint. The third arm is coupled to the frame through a fourth joint. The first, third, and fourth joints are offset from the axis of the shaft by substantially the same distance. The first and third joints are offset in the same direction. The fourth joint is offset in the opposite direction.

10 Claims, 10 Drawing Sheets

PRINT MEDIA TENSIONING APPARATUS INCLUDING GIMBALED ROLLER

CROSS REFERENCE TO RELATED APPLICATIONS

Reference is made to commonly-assigned copending U.S. patent application Ser. No. 12/627,018 filed Nov. 30, 2009 entitled "MEDIA TRANSPORT SYSTEM FOR NON-CONTACT PRINTING", by Muir et al. and to commonly-assigned copending U.S. patent application Ser. No. 12/627,003 (issued as U.S. Pat. No. 8,308,037) filed Nov. 30, 2009 entitled "PRINT MEDIA TENSIONING APPARATUS"

FIELD OF THE INVENTION

This invention relates generally to the field of digitally controlled printing systems, and in particular to the media transport portion of these systems.

BACKGROUND OF THE INVENTION

In high speed inkjet printing systems, print media typically moves through the printing system as a continuous web of print media rather than individual sheets of print media. As the web of media passes through the print system, the print media is held under tension. Variations in the tension of the print media across the width of the print media cause the print media to drift laterally. Precision alignment of the rollers which support and guide the print media reduces the tendency of the print media to drift laterally, but achieving precision alignment of the rollers is, typically, a costly process. As precision alignment of the rollers can reduce or even eliminate drifting of the print media, conventional printing systems typically include servo-controlled web guides to steer the print media to the desired lateral position. While such web guides can be effective, they add significant cost to the printing system.

As such, there is an ongoing need to provide, at a relatively low cost, an apparatus that equalizes the tension of the print media across the width of the print media to reduce or even eliminate the tendency of the print media to drift laterally.

SUMMARY OF THE INVENTION

According to an aspect of the present invention, an apparatus for maintaining uniform tension across a width of a web is provided. The apparatus includes a frame, a roller, a first coupling, a second coupling, and a third coupling. The roller includes a shaft about which the roller rotates. The roller shaft defines an axis of rotation and includes a first end and a second end. The first coupling includes a first arm and a first joint that couples the first end of the roller shaft to the frame such that the roller shaft is free to rotate. The first joint is offset relative to the roller axis by a first distance. The second coupling includes a second arm, a second joint, and a third joint that couples the second end of the roller shaft to the frame. The second arm is free to pivot relative to the roller shaft and the frame through the second joint and the third joint. The third joint is offset relative to the roller axis by a second distance that is substantially equal to the first distance and in the same direction relative to the roller axis. The third coupling includes a third arm and a fourth joint that couples the second end of the roller shaft to the frame. The third arm is coupled to the frame through the fourth joint. The fourth joint is offset relative to the roller axis by a third distance that is substantially equal to the first distance. The offset is in an opposite direction relative to the roller axis.

According to another aspect of the present invention, the fourth joint is constrained to lie substantially in a plane defined by the first joint, the third joint, and a center point located along the length of the roller shaft. The third coupling further comprises a fourth arm and a fifth joint that couples the second end of the roller shaft to the frame, the third arm being coupled to a first end of the fourth arm through the fourth joint located between the third arm and the fourth arm such that the fourth arm is free to pivot relative to the third arm, the fourth joint being offset relative to the roller axis by a second distance that is substantially equal to the first distance but in an opposite direction relative to the roller axis, the second end of the fourth arm being coupled to the frame through the fifth joint such that the fourth arm is free to pivot relative to the frame.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Although the term "paper" is used in this application to refer to print media that is printed on by a printing system, the term "print media" should not be restricted to paper or paper based media. Instead, print media includes any media type that is printed on by the printing system, for example, those that include polymeric or metallic films or foils. Additionally, print media includes media types that include those having woven or non-woven structures.

Figure 1:
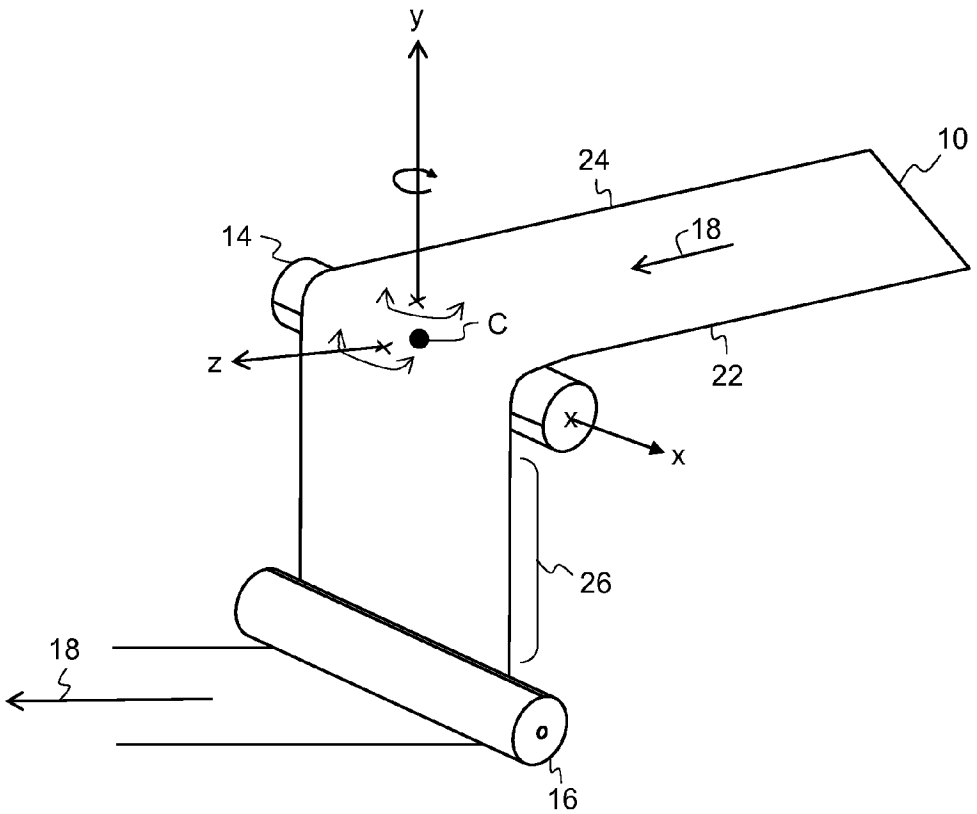
FIG. 1 is an isometric view of a roller guiding a print media web.
Figure 2A:
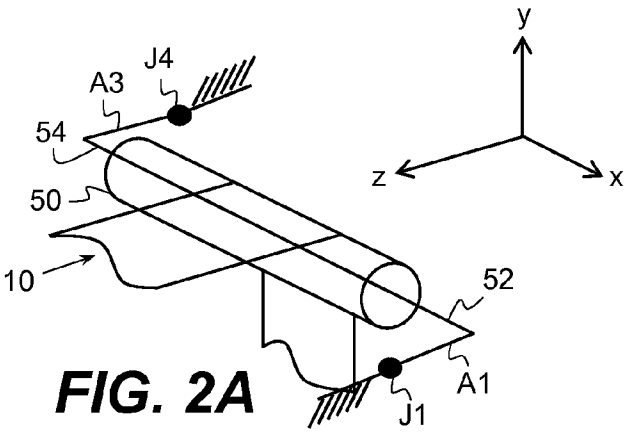
FIG. 2 gives perspective, top, front, and side views of a roller that is configured to allow rotation about a gimbal axis.
Figure 2B:
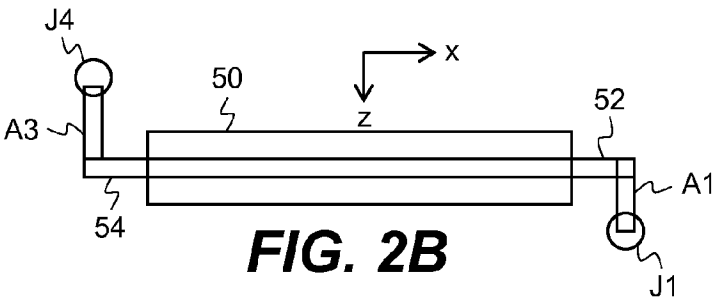
Figure 2C:
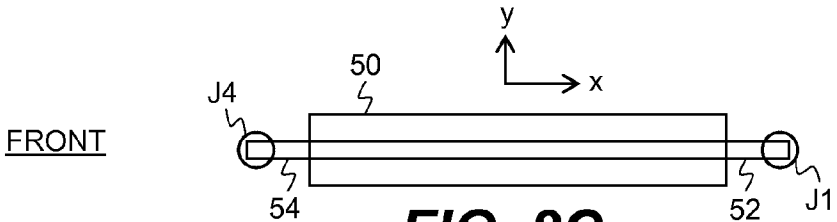
Figure 2D:
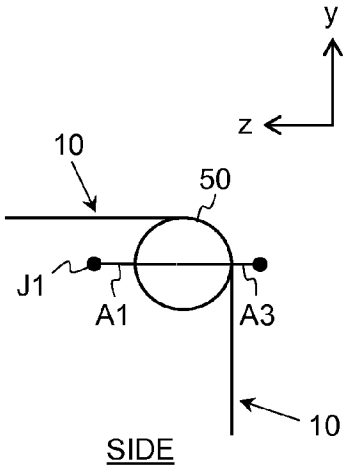
Figure 3A:
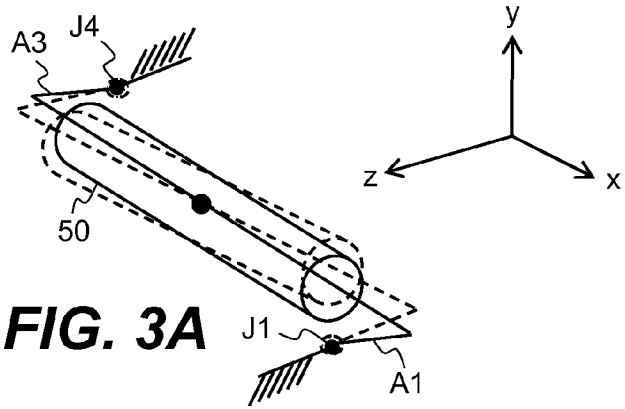
FIG. 3 gives perspective, top, front, and side views of the roller of FIG. 2 as the roller pivots.
Figure 3B:
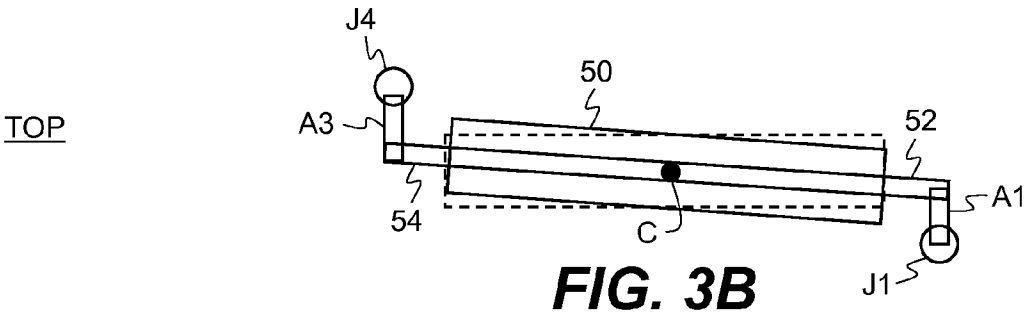
Figure 3C:
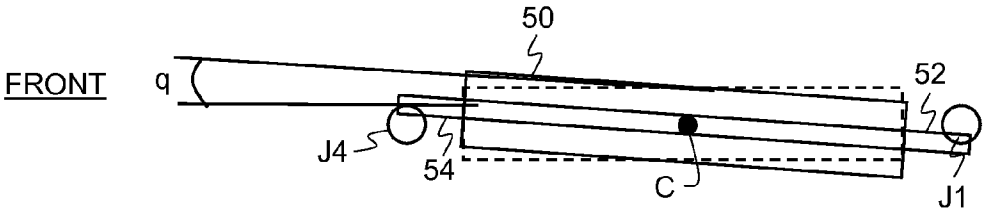
Figure 3D:
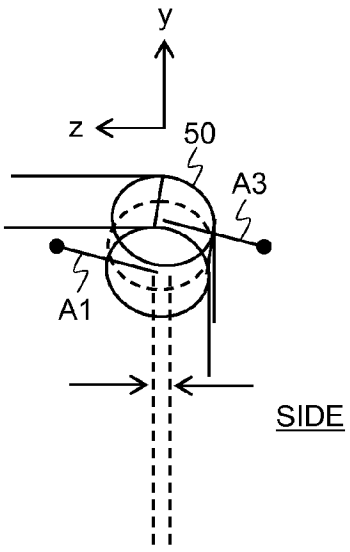

FIG. 1 shows a portion of a paper path for a web of print media 10 passing through a printing system, for example, one of the printing systems described in U.S. patent application Ser. No. 12/627,018 filed Nov. 30, 2009 entitled "MEDIA TRANSPORT SYSTEM FOR NON-CONTACT PRINTING", by Muir et al.

In FIG. 1, the print media 10 comes in from the right and passes over a roller 14 and around a roller 16 before exiting to the left. The print media 10 wraps around a portion of the roller 16 and exits from the bottom of the roller 16 as indicated by the arrows 18. The print media 10 is under tension in the direction of paper motion. If the tension of the print media 10 isn't balanced across its width in the span just preceding roller 14, for example, the tension can be higher along the front edge 22 of the print media web than along the back edge 24 of the print media web. If this happens, the print media as it wraps around the roller 14 tends to drift laterally in the direction of the front edge of the web. Similarly if the tension of the print media isn't balanced across its width in the span 26 between rollers 14 and 16, for example, the tension is higher along the back edge 24 of the print media web than along the front edge 22 of the print media web, the print media as it wraps around the roller 16 then tends to drift laterally in the direction of the back edge 24 of the web.

Print media transport systems, particularly systems that utilize exact constraint or kinematic design, can use various arrangements of castered and gimbaled rollers in order to maintain uniform web tension and reduce or eliminate unnecessary constraints that would otherwise cause unwanted steering or other misalignment along the media path. For example, one such system that applies kinematic principles along the media path for a printing system, called kinematic media transport, is described in commonly assigned U.S. patent application Ser. No. 12/627,018 entitled "MEDIA TRANSPORT SYSTEM FOR NON-CONTACTING PRINTING" by Muir et al. Kinematic media transport is particularly well suited for printing apparatus that provide non-contact application of ink or other colorant onto a continuously moving medium. There are often dynamic considerations with such systems, in which changing conditions of the traveling print medium necessitate compensation by the media handling apparatus in order to maintain proper registration. The printhead of such a device, for example, selectively moistens at least some portion of the media as it courses through the printing system, which can impact media weight and stiffness, including cross-track stiffness, in a variable manner.

Depending on the relative configuration of rollers along the media path, an arrangement of castered and gimbaled rollers can be used to correct for cross-track drift caused by incorrect or variable cross-track web tensioning and thus help to prevent misalignment of the media. With respect to the orthogonal axes shown in FIG. 1, both caster and gimbal movement relate to rotational degrees of freedom (DOF) at a center point C along the roller 14. In the orientation shown, caster relates to rotation about the y-axis. Gimbal relates to rotation about the z axis. Axis x indicates the cross-track direction.

FIG. 2 provides perspective, top, front, and side views of a roller 50 that is configured with a gimbaled mounting, rotatable around joints J1 and J4. Coordinate axes are shown for perspective, top, and front views. Joints J1 and J4 are not aligned with the corresponding first and second ends of the roller shaft 52 and 54, but are offset from the roller axis. The first and second ends of the roller shaft, 52 and 54 are connected to the joints by arms A1 and A3. Arm A1 is rigidly connected to the first end of the roller shaft 52, and arm A3 is rigidly connected to the second end of the roller shaft 54. Print media 10 is approaching the roller 50 from the left. It wraps partially around the roller and leaves the roller in a downward direction.

With the arrangement of FIG. 2, a tension variation across the width of the web as it leaves the roller produces a force at the end of shaft 52 that differs from the force at the end of shaft 54, resulting in a moment (torque), through arms A1 and A3, at joints J1 and J4. As a result, roller 50 rotates about the z axis until forces at either end of the roller shaft are equalized, thereby equalizing cross-track web tension in the span downstream of the roller.

FIG. 3 shows how the gimbal motion occurs with respect to different views and coordinate axes. A rotated position is shown with solid lines, while the unrotated position is represented with dashed lines. As represented in the perspective and front views, gimbal motion relates to rotation about the z axis, relative to center point C, shown as rotating an angle θ in the front view. As shown in the top view of FIG. 3, the rotation about the z axis is accompanied by a smaller amount of rotation about the y axis, causing a small amount of caster angle of the roller. This small rotation about the y axis that accompanies the rotation around the z axis is called a parasitic rotation.

In many applications, the parasitic rotation about the y-axis shown in FIG. 3 is of no consequence, particularly where an upstream roller also has a gimbaled arrangement. In such a case, the upstream roller compensates for the slight amount of caster so that uniform web tension can be maintained across the span approaching the roller 50. However, there are applications for which this parasitic y-axis rotation can cause problems. In printing applications, for example, wherein proper web tensioning is an important factor in dot-to-dot registration, parasitic caster can steer the web, causing misalignment of the media and misregistration. In such applications, then, it is necessary to allow gimbal rotation of a roller to maintain web tension, but to constrain caster rotation to near zero.

Embodiments of the present invention address the problem of maintaining a uniform media web tensioning by providing a web tensioning apparatus that allows gimbal action but more effectively constrains caster rotation, so that parasitic caster rotation is reduced or eliminated, in turn reducing a tendency for unwanted cross-track motion of the moving media within the media transport system.

Figure 4:
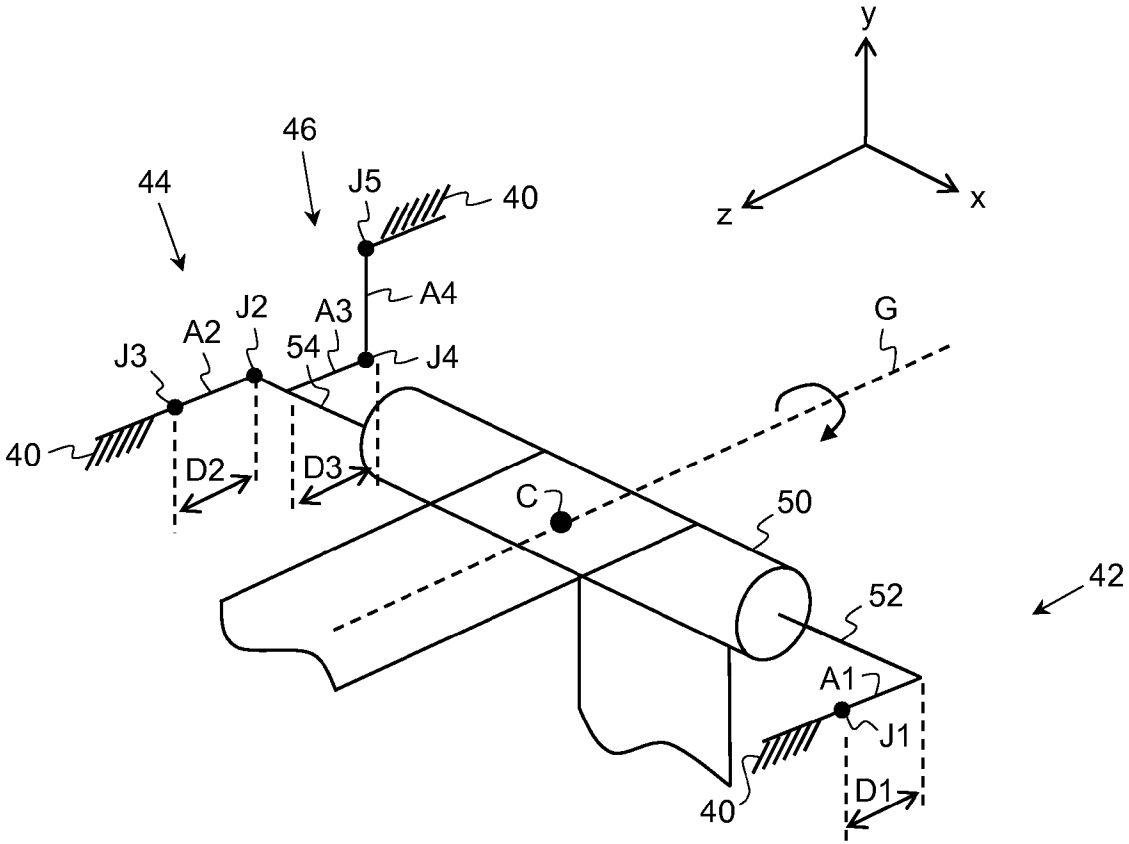
FIG. 4 is a schematic diagram showing an arrangement of pivoting arms and joints used for allowing gimbaled motion in an embodiment of the present invention.

The schematic diagram of FIG. 4 shows an apparatus for maintaining uniform tension across the width of a moving print medium. There are a number of features for providing gimbaled roller 50, rotating about gimbal axis G, with constrained caster rotation according to one embodiment. In this embodiment, a series of links and corresponding joints are used to enable the needed gimbaled movement of roller 50 without appreciable caster. Roller 50 is mounted within an equipment frame 40 and is rotatable about its shaft.

In a first coupling 42, first end 52 of the roller shaft is rigidly connected to a first arm A1 that extends away from the roller axis to a first joint J1 that is mounted to the equipment frame 40, thereby coupling the first end 52 of the roller shaft to the frame 40 through arm A1 and joint J1. The roller shaft is thus free to rotate in all directions around joint J1.

A second coupling 44 and a third coupling 46 are at the opposite end of the roller 50 shaft from the first coupling 42. The second coupling couples the second end 54 of the roller shaft to the frame 40 by means of a second arm A2 and joints J2 and J3. Joints J2 and J3 individually allow arm A2 to pivot freely in all directions relative to the roller shaft 54 and the frame 40, respectively. In one embodiment, joint J2 is substantially in line with the roller 50 axis. The second end 54 of the roller shaft is rigidly connected to a third arm A3 that extends away from the roller axis to a fourth joint J4 that is coupled to the equipment frame 40, thereby coupling the second end 54 of the roller shaft to the frame 40 through arm A3; this coupling forming a third coupling. The fourth joint J4 is not rigidly coupled to the frame. Joint 4 is coupled to frame in a manner that allows the joint 4 to move in the z direction but constrains it to lie substantially in a plane defined by the first joint J1, the third joint J3, and a center point along the length of the roller shaft. This corresponds to constraining joint J4 to lie substantially in the X-Z plane passing through these three points. In the embodiment shown in FIG. 4 this constraint on the position of joint J4 is provided by a fourth arm A4. The fourth arm A4 is coupled to arm A3 by means of joint J4 and is coupled to the frame 40 by means of fifth joint J5. The radius of rotation of rotatable arm A2 is substantially equal to distance DI. Preferably, one or more of joints J1, J2, J3, J4, and J5 are spherical or ball joints although others joint types are permitted.

The length of first arm A1 is an offset distance D1, measured from the roller axis to the pivoting center of joint J1. The length of second arm A2 is a distance D2, the distance between the pivoting centers of joints J2 and J3. The length of third arm A3 is a distance D3, measured from the roller axis to the pivoting center of joint J4. Each of these distances is measured along the z axis. Distances D1, D2, and D3 are substantially equal to each other.

Still referring to FIG. 4, operation of the apparatus for maintaining uniform web tension is described. The print media 10 moves around a portion of roller 50. A tension variation across the width of the web of print media 10 in the web span leaving the roller 50 produces a force at the end of shaft 52 that differs from that at the end of shaft 54, resulting in a moment (torque) at joints J4 and J1. As a result, roller 50 rotates about the z-axis (G) to equalize forces at either end of the roller shaft, causing one end of the roller shaft to move up while the other end of the roller shaft moves down, these movements being in the plus and minus Y directions of FIG. 4. As arm A1 rotates about joint J1, the end of arm A1 attached to the roller shaft moves in the z direction. This also moves the first end 52 of the roller shaft in the z direction. Failure to move the second end of the roller shaft by the same amount in the z direction would impart an unwanted caster angle rotation of roller 50 about the y axis. Second and third couplings 44 and 46 cooperate to eliminate such parasitic caster rotation.

As arm A1 rotates, pivoting about joint J1 in one direction, arm A3, pivoting at joint J4, rotates in the opposite direction by a corresponding amount. Since distances D1 and D3 are equal, the rotations at the two ends of the roller shaft are equal. As a result rotation of the roller takes place about center point C, along axis G. Arms A2 and A4 cooperate in such a way that joint J4 is able to move slightly in the z direction, thereby forcing roller shaft end 54 to move in the z direction by the same amount as shaft end 52 does. Arm A2 is attached at one end to frame 40, and at the other end to the roller shaft. Thus, as arm A3 rotates, arm A2 also rotates. Rotation of arm A2 moves that end of the roller shaft in the z direction a distance equal to the equivalent z direction movement of the other end of the shaft as connected to arm A1 since distance D2 is substantially equal to distance D1. Thus, angular rotation about the y axis, or caster, is eliminated.

It can be observed that end of roller shaft 54 is free to move in the z direction by its connection to frame 40 through arm A4. One end of arm A4 is connected to arm A3 at joint J4. The other end of arm A4 connects to frame 40 through joint J5. Preferably joint J5 and joint J4 lie in a Y-X plane that is substantially perpendicular to the X-Z plane, which contains joints J1 and J3 and the center point C; the X-Y plane being parallel to the roller axis. Small rotations of arm A4 around joint J5 permit joint J4 to move small amounts in the z direction without significant motion in the y direction. As a result the fourth joint J4 is constrained to lie substantially in the plane defined by the first joint, J1, the third joint J3, and the center point C that is located along the length of the roller shaft.

The cooperative effect of arms A1 and A2 in preventing caster rotation can be more readily visualized by considering their equal lengths D1 and D2, respectively, with joints J1 and J3 both mounted to frame 40. Since joint J2 remains substantially in line with the roller shaft during gimbal rotation about the z axis, rotation about the y axis, or caster, is effectively constrained with this mechanical arrangement.

Figure 5A:
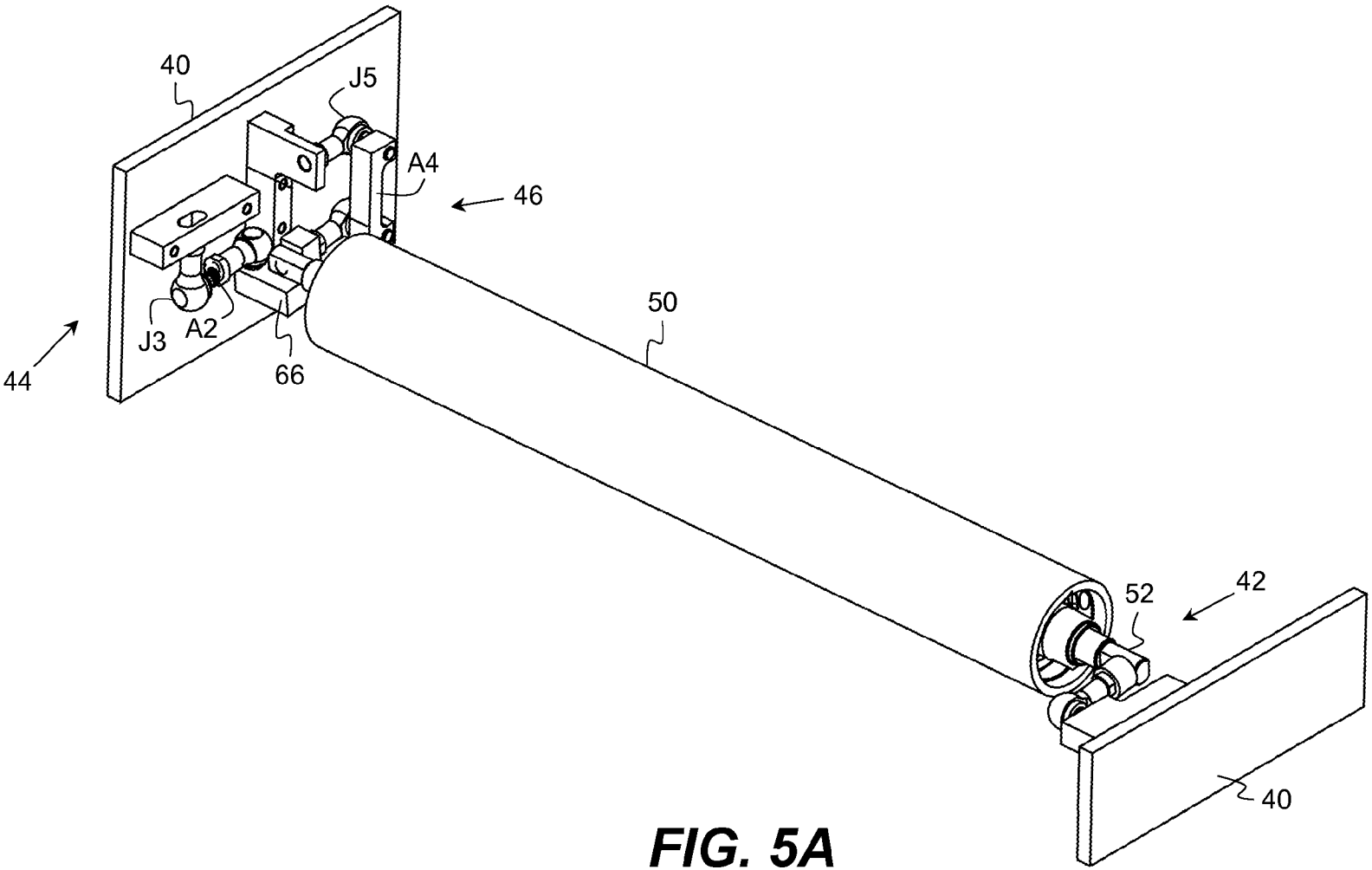
FIG. 5A is a perspective view of a gimbal mechanism in one embodiment.
Figure 5B:
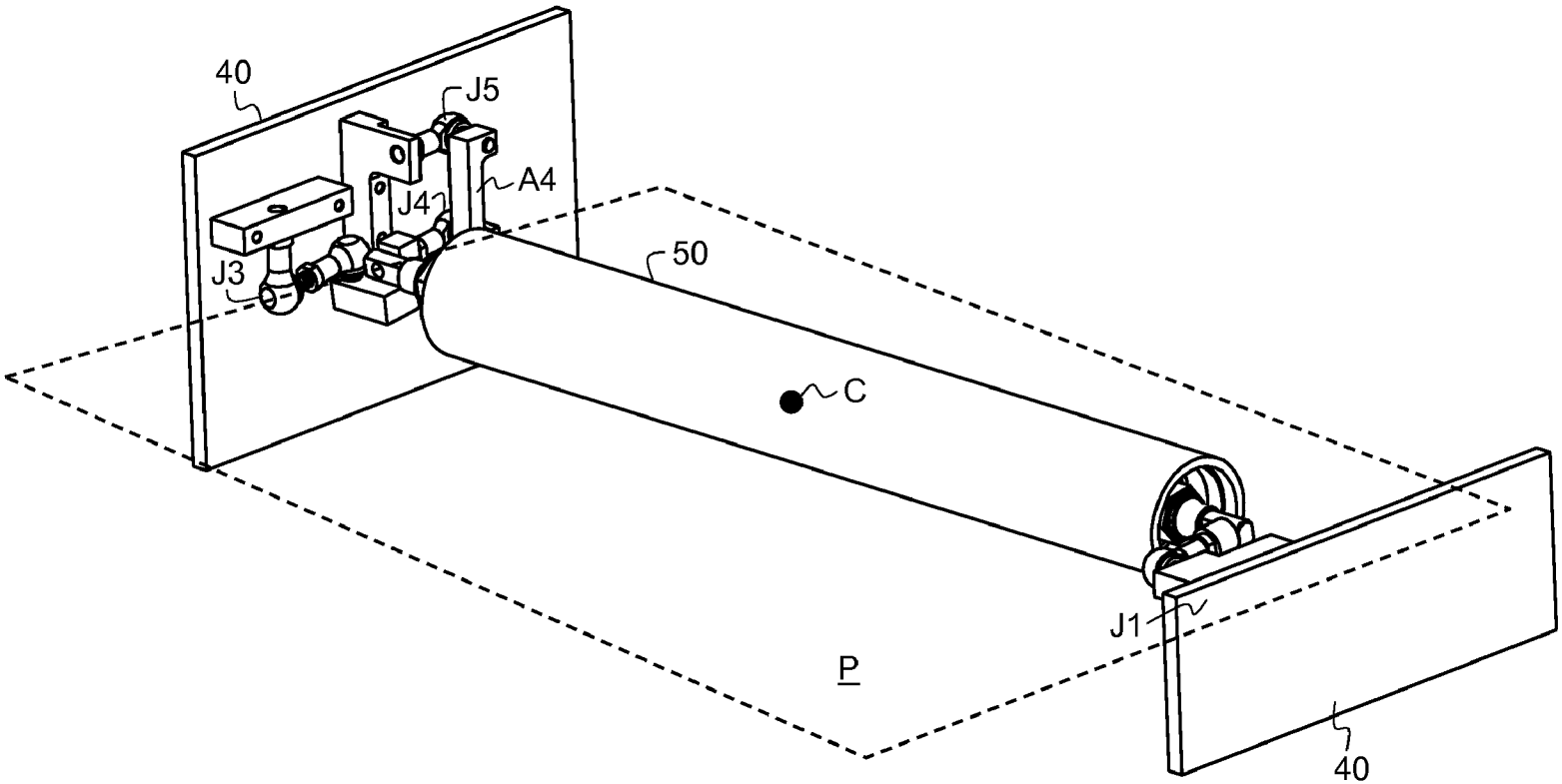
FIG. 5B is a perspective view of a gimbal mechanism in one embodiment, showing a plane that helps to define preferred component positioning for a gimbal apparatus used to maintain uniform web media tension.
Figure 6:
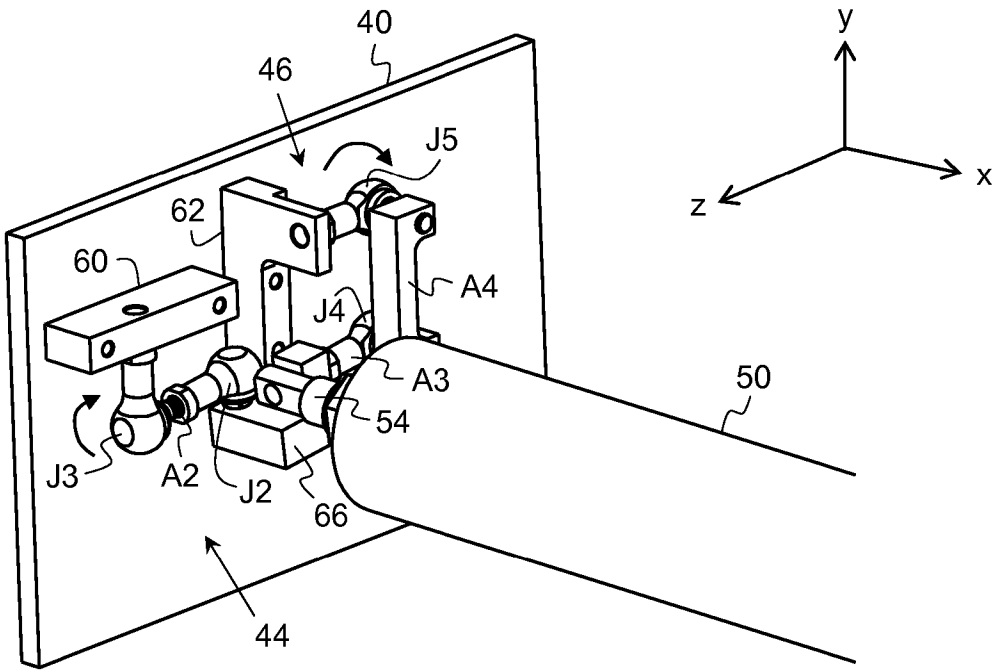
FIG. 6 is an enlarged perspective view that shows components of the second and third couplings for a gimbal mechanism.

The perspective views of FIGS. 5A, 5B, and 6 show an embodiment of roller 50 within frame 40 using the components and mechanical linkage described with reference to the schematic diagram of FIG. 4. The perspective view of FIG. 6 shows an enlarged view of mechanical components closest to second end 54 of the roller shaft. Mounts 60 and 62 are fastened to frame 40 and provide a platform for pivoting movement about appropriate axes for other joint and arm components. In this arrangement, as shown in FIG. 5B, fourth joint J4 is constrained so that it lies substantially in the same plane P as a center point C along the length of the roller 50 shaft and first and third joints J1 and J3, respectively. Fifth joint J5 can be offset relative to this plane.

Referring to FIG. 6, the second end 54 of the roller shaft is coupled to the frame 40 by a third coupling 46 made up of third arm A3, fourth joint J4, fourth arm A4, and fifth joint J5. Third arm A3 is coupled to a first end of fourth arm A4 through joint J4 that lies between third arm A3 and fourth arm A4. Fourth arm A4 is free to pivot relative to third arm A3; the fourth joint J4 is offset relative to the roller 50 axis by distance D2 (FIG. 4), with the displacement offset in the opposite direction relative to the roller axis from offset distance D1. A second end of fourth arm A4 is coupled to frame 40 through fifth joint J5, so that fourth arm A4 is free to pivot relative to frame 40.

The second end 54 of the roller shaft is also coupled to the frame 40 by second coupling 44 that is made up of second joint J2, second arm A2, and third joint J3. In the embodiment of FIG. 6, joint J2 is coupled to the second end 54 of the roller shaft by means of suspended block 66 that is rigidly connected to the second end 54 of the roller shaft. As shown in FIG. 6, joint J2 is aligned with the roller axis, while joint J3 is offset relative to the roller 50 axis. As FIG. 4 showed, this offset is distance D2, which is equal to distance D1.

Figure 7:
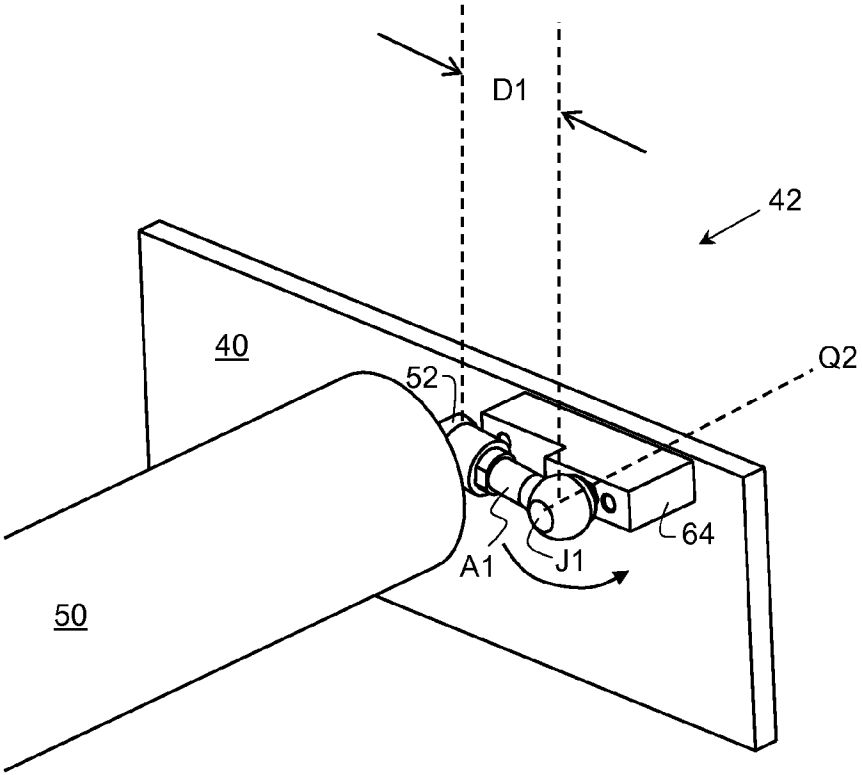
FIG. 7 is an enlarged view that shows components of the first coupling for a gimbal mechanism.

The perspective view of FIG. 7 shows an enlarged view of mechanical components closest to first end 52 of the roller shaft. A mount 64 is attached to frame 40 and provides the stationary pivot point for joint J1. At this end of roller 50, first coupling 42, made up of the first arm A1 and first joint J1, thus couples the roller 50 shaft to frame 40, allowing rotation of roller 50 about the axis of arm A1 and also allowing rotation of arm A1 and roller 50 about a second axis Q2 that is parallel to the roller axis and offset relative to the roller axis by distance D1.

Figure 8:
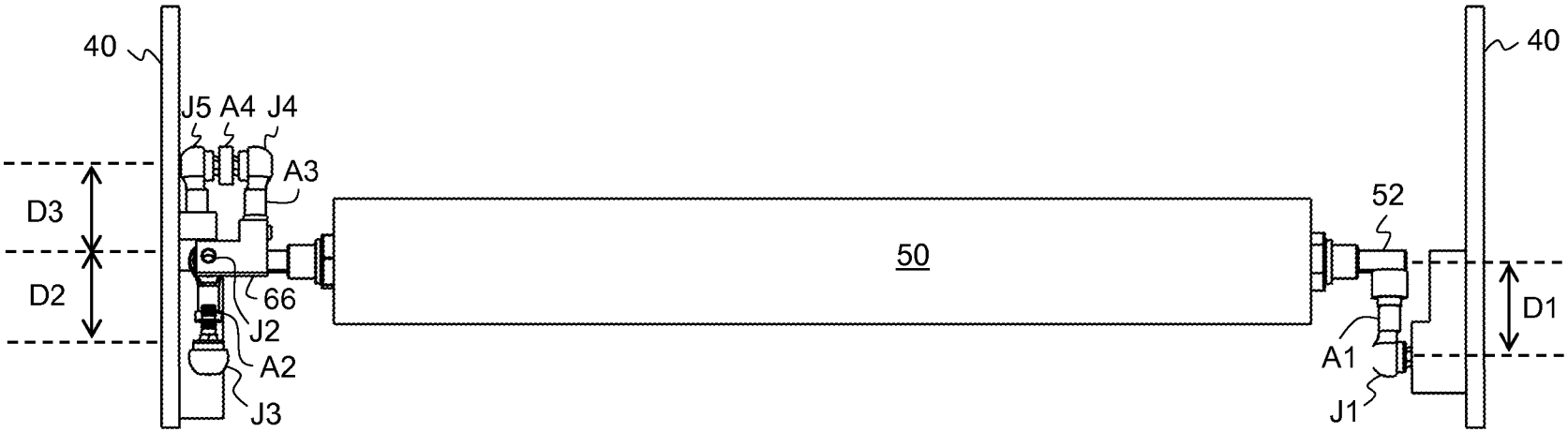
FIG. 8 is a bottom view showing gimbal mechanism components and distances.
Figure 9:
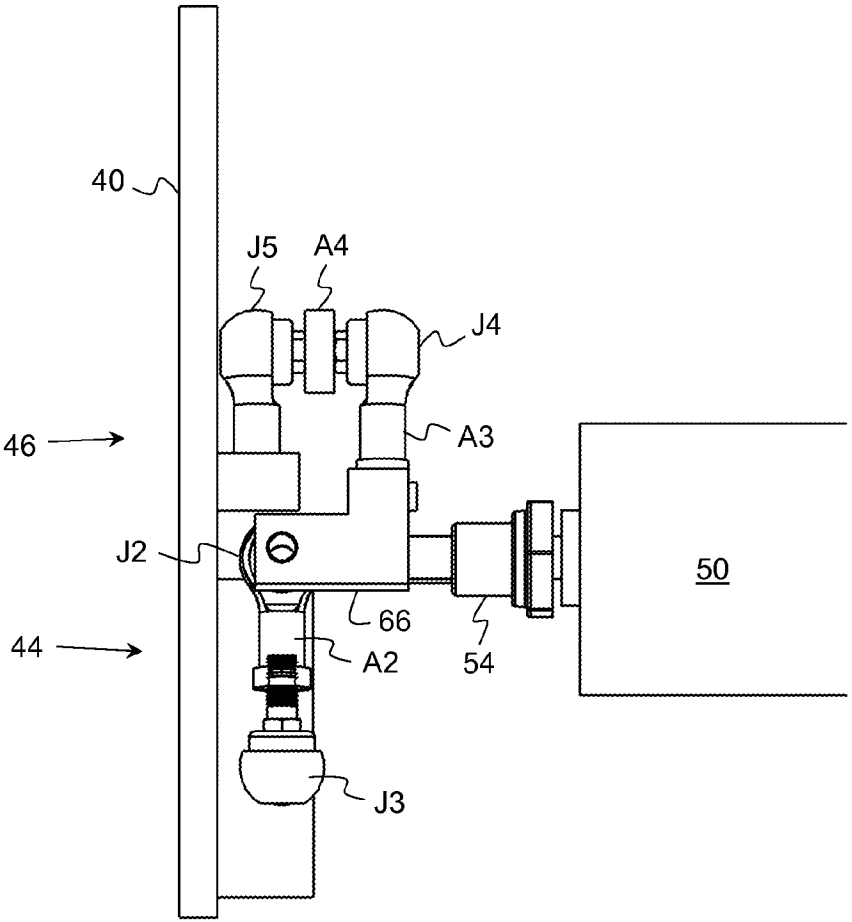
FIG. 9 is a bottom view showing components of the second and third couplings.

FIG. 8 is a bottom view of roller 50 and its support components, showing equal distances D1, D2, and D3 from a different perspective. The bottom view of FIG. 9 is an enlarged view of components nearest to second end 54 of the roller shaft. A suspended block 66 is the movable member that is coupled to second end 54 of the roller shaft and is suspended from the frame by virtue of the jointed coupling to arm A2 at joint J2 and its coupling to arm A3. Suspended block 66 is rigidly coupled to second end 54 of the roller shaft.

Joint J2 and arm A3 both couple to the second end 54 of the roller shaft by means of this suspended block As shown in FIG. 9, fourth arm A4, pivoted on a fifth joint J5, forces a constraint in the y direction (normal to the page in this view). Because its pivoting action provides a degree of freedom in the z direction, along the arc of curvature from joint J5, as best seen in FIG. 6, it is advantageous to make fourth arm A4 longer than the other arms of the gimbal control link assembly, longer than distances D1, D2, and D3. This arrangement helps to minimize movement of fourth joint J4 out of the plane P (FIG. 5B) defined by joints J1 and J3 and center point C.

In operation, unwanted z-direction movement of one end of roller 50 relative to the other end of the roller, corresponding to unwanted caster movement, is controlled by the combination of linkages on both sides of frame 40, while allowing gimbal movement at the same time. The combined interaction of these components provides equal foreshortening in the z direction, effectively compensating any rotation about the y-axis and constraining caster.

Since both the second arm A2 and the fourth arm A4 can rotate freely as a result of joints J2 and J3, and joints J4 and J5 respectively, the mounting of the second end of the roller shaft 54 by means of couplings 44 and 46 is insensitive to small variations in the spacing between the frame portions on the first and second end of the roller shaft. This simplifies installation of the gimbaled roller assembly and makes it insensitive to thermal expansion differences between the roller shaft and the frame.

The invention has been described in detail with particular reference to certain preferred embodiments thereof, but it will be understood that variations and modifications can be effected within the scope of the invention.

PARTS LIST

10 Print media
12 Roller
14 Roller
16 Roller
18 Arrow
22 Front Edge
24 Back Edge
26 Span
40 Frame
42 First coupling
44 Second coupling
46 Third coupling
50 Roller
52 First end of roller shaft
54 Second end of roller shaft
60 Mount
62 Mount
64 Mount
66 Suspended Block
A1 First arm
A2 Second arm
A3 Third arm
A4 Fourth arm
C Center point
D1 First distance
D2 Second distance
D3 Third distance
J1 First joint
J2 Second joint
J3 Third joint
J4 Fourth joint
J5 Fifth joint
G Gimbal axis
Q2 Axis
P Plane

The invention claimed is:

1. An apparatus for maintaining uniform tension across a width of a web, the apparatus comprising:

a frame;

a roller including a shaft about which the roller rotates, the roller shaft defining an axis of rotation, the roller shaft including a first end and a second end;

a first coupling that couples the first end of the roller shaft to the frame such that the roller shaft is free to rotate, the first coupling including a first arm and a first joint, the first end of the roller shaft being rigidly connected to the first arm, the first arm extending away from the roller shaft to the first joint, the first joint being offset relative to the roller axis by a first distance;

a second coupling that couples the second end of the roller shaft to the frame, the second coupling including a second arm, a second joint, and a third joint, the second arm being free to pivot relative to the roller shaft and the frame through the second joint and the third joint, respectively, the third joint being offset relative to the roller axis by a second distance that is substantially equal to the first distance and in the same direction relative to the roller axis; and a third coupling that couples the second end of the roller shaft to the frame, the third coupling including a third arm and a fourth joint, the third arm being rigidly coupled to the second end of the roller shaft and coupled to the frame through the fourth joint, the fourth joint being offset relative to the roller axis by a third distance that is substantially equal to the first distance, the offset being in an opposite direction relative to the roller axis.

2. The apparatus of claim 1, wherein the first coupling couples the first end of the roller shaft to the frame such that the roller shaft is free to rotate around a first axis that is perpendicular to the roller and a second axis that is substantially parallel to the roller axis and offset relative to the roller axis by the first distance.

3. The apparatus of claim 1, wherein the fourth joint is constrained to lie substantially in a plane defined by the first joint, the third joint, and a center point located along the length of the roller shaft.

4. The apparatus of claim 3, wherein the third coupling further comprises a fourth arm and a fifth joint that couples the second end of the roller shaft to the frame, the third arm being coupled to a first end of the fourth arm through the fourth joint located between the third arm and the fourth arm such that the fourth arm is free to pivot relative to the third arm, the fourth joint being offset relative to the roller axis by the third distance that is substantially equal to the first distance but in an opposite direction relative to the roller axis, the second end of the fourth arm being coupled to the frame through the fifth joint such that the fourth arm is free to pivot relative to the frame.

5. The apparatus of claim 4, wherein the fifth joint is located offset relative to the plane.

6. The apparatus of claim 4, wherein the fifth joint is located offset relative to the fourth joint by a fourth distance that is greater than or equal to the first distance.

7. The apparatus of claim 1, wherein the second joint is located substantially in line with the roller axis.

8. The apparatus of claim 1, wherein the third joint is located substantially in line with a second axis that is substantially parallel to the roller axis and offset relative to the roller axis by the first distance.

9. The apparatus of claim 1, wherein one or more of the joints include spherical joints.

10. A method of maintaining uniform tension across a width of a web of media comprising:

providing an apparatus including:

a frame;

a roller including a shaft about which the roller rotates, the roller shaft defining an axis of rotation, the roller shaft including a first end and a second end;

a first coupling that couples the first end of the roller shaft to the frame such that the roller shaft is free to rotate, the first coupling including a first arm and a first joint, the first end of the roller shaft being rigidly connected to the first arm, the first arm extending away from the roller shaft to the first joint, the first joint being offset relative to the roller axis by a first distance;

a second coupling that couples the second end of the roller shaft to the frame, the second coupling including a second arm, a second joint, and a third joint, the second arm being free to pivot relative to the roller shaft and the frame through the second joint and the third joint, respectively., the third joint being offset relative to the roller axis by a second distance that is substantially equal to the first distance and in the same direction relative to the roller axis; and a third coupling that couples the second end of the roller shaft to the frame, the third coupling including a third arm and a fourth joint, the third arm being rigidly coupled to the second end of the roller shaft and coupled to the frame through the fourth joint, the fourth joint being offset relative to the roller axis by a third distance that is substantially equal to the first distance, the offset being in an opposite direction relative to the roller axis; and causing a media to move around a portion of the roller of the apparatus.

* * * * *